US007712539B2

(12) United States Patent
Einar

(10) Patent No.: US 7,712,539 B2
(45) Date of Patent: May 11, 2010

(54) RISER FOR CONNECTION BETWEEN A VESSEL AND A POINT AT THE SEABED

(76) Inventor: Kjelland-Fosterud Einar, Hosletoppen 30, Hosle (NO) N-1362

( * ) Notice: Subject to any disclaimer, the term of this patent is extended or adjusted under 35 U.S.C. 154(b) by 237 days.

(21) Appl. No.: 10/492,913

(22) PCT Filed: Sep. 26, 2002

(86) PCT No.: PCT/NO02/00346

§ 371 (c)(1),
(2), (4) Date: Apr. 16, 2004

(87) PCT Pub. No.: WO03/033856

PCT Pub. Date: Apr. 24, 2003

(65) Prior Publication Data

US 2004/0244984 A1 Dec. 9, 2004

(30) Foreign Application Priority Data

Oct. 9, 2001 (NO) ..... 20015121

(51) Int. Cl.
*E21B 29/12* (2006.01)

(52) U.S. Cl. ..... 166/355; 166/367; 166/350; 405/224.4

(58) Field of Classification Search ..... 166/350, 166/352–355; 405/224.2–224.4
See application file for complete search history.

(56) References Cited

U.S. PATENT DOCUMENTS 3,359,741 A * 12/1967 Nelson ..... 405/200
3,602,174 A * 8/1971 Gorman ..... 114/293
3,794,849 A * 2/1974 Perry et al. ..... 307/147
3,834,432 A * 9/1974 Lilly et al. ..... 141/388
3,841,357 A * 10/1974 Heijst ..... 138/120
4,023,517 A * 5/1977 Ryan ..... 114/230.13
4,029,039 A * 6/1977 van Heijst ..... 441/3
4,200,054 A * 4/1980 Elliston ..... 114/264
4,290,715 A * 9/1981 Beynet et al. ..... 405/169
4,310,263 A * 1/1982 Daughtry ..... 405/169
4,363,567 A * 12/1982 Van der Graaf ..... 405/224.2
4,448,266 A * 5/1984 Potts ..... 175/7
4,459,066 A * 7/1984 van der Graaf ..... 405/224.3
4,645,467 A * 2/1987 Pollack ..... 441/4
4,704,050 A 11/1987 Wallace
4,735,267 A * 4/1988 Stevens ..... 166/345
4,802,431 A * 2/1989 Pollack ..... 114/230.13
4,906,137 A * 3/1990 Maloberti et al. ..... 405/224.3
5,118,221 A * 6/1992 Copple ..... 405/224.2
5,794,700 A * 8/1998 Pollack ..... 166/339

(Continued)

FOREIGN PATENT DOCUMENTS

EP 1172518 1/2002

(Continued)

*Primary Examiner*—Thomas A Beach
(74) *Attorney, Agent, or Firm*—Christian D. Abel

(57) ABSTRACT

A riser for connection between a vessel and a fixed connection point on the seabed, in the form of an "L", where the bottom riser arm is connected to the fixed point (2) on the seabed and the top riser arm (3) is connected to the vessel at the point (4). An elastic element (5) is connected to the bend (6) between the riser's arms and an anchoring point (7) on the seabed.

10 Claims, 5 Drawing Sheets

U.S. PATENT DOCUMENTS

| | | | | |
|---|---|---|---|---|
| 6,109,830 | A * | 8/2000 | de Baan | 405/170 |
| 6,109,833 | A * | 8/2000 | Savy | 405/195.1 |
| 6,321,844 | B1 * | 11/2001 | Thiebaud et al. | 166/345 |
| 6,558,215 | B1 * | 5/2003 | Boatman | 441/5 |
| 6,685,397 | B1 * | 2/2004 | Dixon-Roche | 405/224.2 |
| 6,854,930 | B2 * | 2/2005 | Pionetti | 405/172 |
| 6,857,822 | B2 * | 2/2005 | Hooper et al. | 405/224.4 |
| 7,189,029 | B2 * | 3/2007 | Pionetti | 405/224.2 |
| 2004/0026081 | A1 * | 2/2004 | Horton, III | 166/346 |
| 2004/0163817 | A1 * | 8/2004 | Horton, III | 166/367 |
| 2004/0244984 | A1 * | 12/2004 | Kjelland-Fosterud | 166/367 |
| 2005/0196243 | A1 * | 9/2005 | Pollock et al. | 405/224.3 |
| 2006/0056918 | A1 * | 3/2006 | Luppi | 405/169 |
| 2008/0089745 | A1 * | 4/2008 | Salome et al. | 405/224.2 |

FOREIGN PATENT DOCUMENTS

| | | |
|---|---|---|
| WO | WO 97/21017 | 6/1997 |
| WO | WO 97/30265 | 8/1997 |

* cited by examiner

RISER FOR CONNECTION BETWEEN A VESSEL AND A POINT AT THE SEABED

The invention relates to a riser for connection between a floating structure and a fixed connection point on the seabed. Risers are used for transporting petroleum products from a well to a processing installation onboard a floating structure, for exporting petroleum products, and for providing a subsea installation with chemical substances and control signals.

BACKGROUND OF THE INVENTION

There are several ways a floating structure may be hold steady in relation to a point at the seabed. It may be anchored with inclined anchor lines or vertical anchor lines (as a tension leg platform) or it may be dynamically positioned. In all these different methods will the vessel or platform undergo some movements vertically and horizontally due to waves, wind currents or similar. For all these methods there would be set limits for how much the vessel or platform is allowed to move vertically and horizontally, but there will always be some dynamics in a system with a riser between a point at seabed and a floating vessel or platform, and there are several ways to handle this dynamics.

For a floating structure that is vertically anchored (a tension leg platform) so that the length of the risers is more or less constant, metal risers may be employed that are straight and vertical. Even if the floating structure is a tension leg platform there will be some movement and the risers are normally equipped with heave compensators on the platform deck to compensate for small changes in length and stiffness. Generally there is always a wish for reducing the amount of equipment on a vessel or platform, due to limitations in weight and space. The riser is also usually equipped with stress joints at the seabed. Such stress joint are lengths of tapered pipe. Since stress joints scale to some power of the diameter, they become very large as the diameter is increased, and this imposes practical limits on their maximum diameter.

For vessels or platforms that use inclined anchor lines or are dynamically positioned, the distance between the riser's end point on the vessel and on the seabed may vary considerably due to alterations in the vessel's draught, tides, wind and waves, or as a result of damage to the vessel or the anchor system. In such cases flexible hoses are commonly used, often equipped with buoyancy and ballast to increase their flexibility. Flexible hoses are expensive and there is a wish for using metal risers.

The simplest form is a J-shape, where the riser is in the form of a catenary from the tangential point on the seabed to the platform. This is only suitable for applications where the water depth is several times the maximum horizontal platform movement and where the dynamic platform motions are limited.

A more common form is that of a reclining "S", where the weight of the hose makes it concave up near the end that is connected to the platform, and buoyancy elements make it concave down near the end that is connected to the seabed. From here a continuation resting on the seabed leads to an installation at the seabed. The riser is kept taut by one or two anchor ropes fastened to an anchor. The total length of this riser configuration is approximately 3 times the water depth, and the radii of curvature are so small that the pipe has to be in the form of a flexible hose. In an attempt to use titanium, which can withstand substantially smaller bending radii than steel, it was found that the pipes had to be bent to nearly their final shape, which resulted in considerable installation problems.

One possible solution for a riser configuration with rigid riser elements is a riser as described in WO 97/21017. The riser between the connection point at the seabed and the floating platform, consists of two rigid elements connected with a weighted bend in an angle of more or less 90 degrees near the seabed. This configuration, however, allows for only small movements of the floating structure in a horizontal plane. This is so because the weighted bend always will tend to keep the riser part between the bend and the floating platform in a vertical position and this will give unwanted and critical forces in the substantially horizontal part of riser.

The object of the present invention is to replace these known arrangements with one that allows a shorter riser and which riser does not require buoyancy elements, while at the same time having large flexibility in relation to movements of the floating structure. Another object is to achieve a riser consisting mainly of straight pipe elements, and which is of such a nature that the limited flexibility of metal (steel or titanium) is adequate. A further object of the invention is to produce a riser system with large flexibility in relation to movements of the floating structure which at the same time does not use much space on the seabed.

SUMMARY OF THE INVENTION

These objectives are achieved with a riser system in accordance with the following claims.

A riser in accordance with the invention for connection between a floating structure and a point on or near the seabed for transport of fluids, electric power and/or signals, consists of two substantially rigid parts, a bottom riser arm and a top riser arm. The two part are substantially straight in an unloaded condition. The bottom riser extends from the connection point on or near the seabed to a substantially rigid bend, and the top riser extends from the bend to the floating structure. The angle between the two parts of the riser is approximately 90 degrees, and at least one elastic element extends from the bend to an anchor on the seabed in a distance from the bend and in a direction mainly opposite of the bottom riser.

The bend is in the vicinity of the seabed, and when the riser and floating structure is in a neutral position, the horizontal projections of the riser's connection point to the floating structure and the riser's connection point on or near the seabed are on the same side of the horizontal projection of the bend. Also when the floating structure is in a neutral position will the bend be in the vicinity of the seabed, so that the longitudinal axis of the bottom riser arm extends with an acute angle in relation to a horizontal plane, and with for the entire length or parts of have an almost catenary shape. The bottom riser arm will have a longitudinal axis which is close to horizontal Further aspects of the invention is that a transition point, where the bottom riser arm is lifted off the seabed, is approximately on a vertical line from the riser's connection point to the floating structure, and that the angle between the elastic element and the top riser arm, opposite the bottom riser arm, is between 60 and 180 degrees, preferably between 80 and 120 degrees.

The elastic element or a bundle of elastic elements are so mounted that it absorbs tension forces in a horizontal plane, so that the bottom riser arm mainly experiences bending forces.

In comparison with these known designs risers according to the invention have significant advantages:

Reduced length (approximately 50% compared to the S-configuration)

Steel pipes instead of flexible hoses

Reduced load on the platform compared to flexible hoses

Reduced space requirements on the seabed

Even if highly alloyed materials should be required for reasons of corrosion, the price per meter for the pipes will be less than half the price of corresponding flexible hoses. Also, the pressure and temperature tolerance of metals will be far better than for the plastics that constitute the sealing element in a flexible hose. Since the length is approximately half, a riser according to the invention will cost ¼ to ½ of a corresponding riser made of flexible hose. In addition savings are made on buoyancy elements, which are considerably more expensive than the anchor rope required by risers according to the invention.

BRIEF DESCRIPTION OF THE DRAWINGS

The invention will now be explained in more detail with embodiments of the present invention with references to the enclosed drawings where.

DETAILED DESCRIPTION OF THE INVENTION

Figure 1:
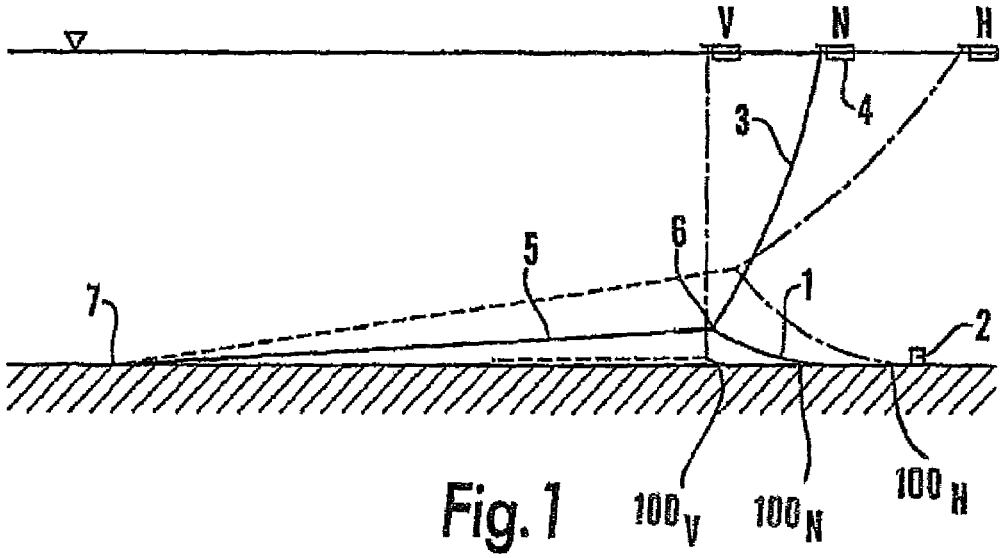
FIG. 1 describes the present invention, where the vessel or platform is in three different positions, a neutral position N, maximum to the left V and maximum to the right H, with corresponding transition points 100N, 100V and 100H where the bottom riser arm is lifted off the seabed in the respective positions.

As shown in FIG. 1, a riser designed in accordance with the invention is in the form of an L where the bottom riser arm 1 is connected to the fixed point 2 on the seabed, and the top riser arm 3 is connected to a vessel or platform 4. An elastic element 5, which may be a chain and/or an elastic rope or a combination and may utilize submerged buoys and/or weights, but preferably is a rope of synthetic material, extends from the bend 6 between the riser's arms to an anchor 7 on the seabed.

First of all we shall describe the shape a riser according to the invention will assume in calm water, when the riser's top connection point, the vessel or platform, is moved in the riser's plane. We shall thereafter describe how movements across the plane influence the shape, and the effect of currents and waves.

The figures are drawn in such a manner that the riser's anchor 7 is located on the left of the vessel 4, and the description is in accordance with this. When the vessel 4 is in its extreme left position V, the upper arm 3 of the riser inclines 0-10 degrees to the right, the bend 6 is near the seabed, and the bottom riser arm 1 is mostly lying on the seabed. The rope 5 is stretched to approximately 10% of its breaking load. In the opposite extreme position H the vessel 4 is moved to the right of the figure corresponding to a maximum of 72% of the water depth. The rope 5 is then stretched to 50-60% of its breaking load. The riser's two arms 1 and 3 are almost catenary in shape, since the riser arms are so long relative to their diameter that the bending stiffness does not affect the shape to a noticeable degree, except from near the ends.

For catenaries the shape is determined by the balance of forces: at a point where the distance along the chain from the horizontal tangential point is S, the angle A between the chain and the horizontal plane is given by the formula $\tan(A)=H/Sw$, where H is the horizontal tension and w is the chain's weight per meter. The shape of the riser in FIG. 1 is calculated according to this formula. The radius of curvature, which is proportional to the bending stress, is given by the formula $R=2H/(w*(1+\cos(2A))$. It follows that the radius of curvature is least and the bending stress is maximum where the catenary is horizontal. It also follows that the angle between the riser arms are approximately constant at 90 degrees, whether the floating structure is in extreme left, neutral or extreme right positions. This feature greatly simplifies the design of the bend 6.

If one disregards ovalisation of the cross section that occurs when the pipe wall is thin relative to the pipe diameter, the bending stress in elastic materials is equal to $(E*r/R)$ where E is the modulus of elasticity, r=the pipe's outer radius and R is the radius of curvature.

FIG. 1 illustrates that the shape of the lower riser arm 1 resembles a circular arc and the upper riser arm 3 has a substantially larger radius of curvature than the lower arm.

Figure 2:
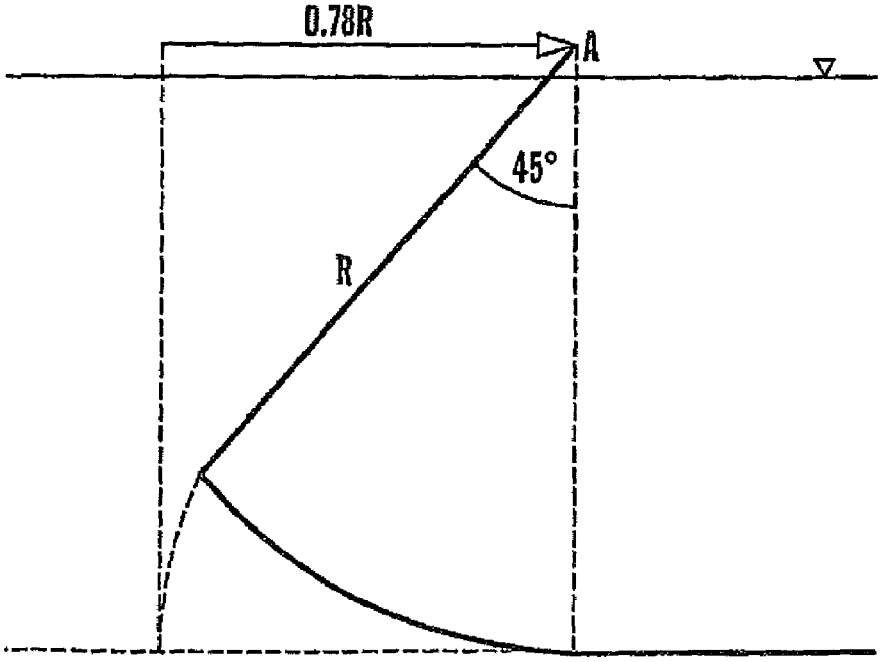
FIG. 2 shows a geometrical shape that resembles the riser in accordance with the invention, FIG. 3 describes a second embodiment of the elastic element in accordance with the invention, FIG. 4 describes a third embodiment of the elastic element, FIG. 5 describes a fourth embodiment of the elastic element.

FIG. 2 illustrates a geometry resembling a riser according to the invention. Here the upper arm is straight, the angle between the riser arms is 90 degrees, and the lower arm is a circular arc with a radius equal to the length of the upper arm. In the figure the upper arm is rotated 45 degrees, and it can be seen that the end point of the upper arm moves parallel to the tangential plane a distance equal to 0.78 times the radius of the bottom arm.

Since a riser according to the invention resembles the geometry in FIG. 2, it is obvious that this can absorb substantial horizontal movements of the vessel by the lower riser arm being lifted from the seabed to a greater or lesser degree and assuming the form of an arc. In order to lift the bottom riser arm 1, the angle between the elastic element 5 and the top riser arm 3 requires to be less than 180 degrees, thus placing a geometrical limit on how far to the right the vessel 4 can be moved. It will be obvious that a riser shaped in this way will have a length less than twice the depth of the water, i.e. considerably shorter than the S-shaped riser described above.

The radii of curvature of the two riser arms 1 and 3 are determined by the force in the elastic element 5, which is distributed between the upper and the lower riser arms. When the vessel 4 is moved to the right, the elastic element 5 is extended. At the same time the horizontal component of the axial force in the upper riser arm 3 increases. With a suitable length and elasticity in the elastic element 5, the force therein increases approximately to the same extent as the horizontal component of the axial force in the upper riser arm. The horizontal force in the lower riser arm is thereby approximately constant, and consequently also its radius of curvature.

The position of the bend 6 in the two extreme positions and the force required in the elastic element 5 in these extreme positions in order for the radius of curvature in the lower riser arm 1 to exceed a minimum with a suitable margin provide the basis for calculating the necessary diameter and length of the elastic element 5 when its modulus of elasticity and maximum permitted tension are known.

If the vessel 4 is moved perpendicularly to the riser's plane, the bend 6 will be moved until the balance of forces is satisfied. The lower riser arm 1 has to slide over the seabed, and the movement is reduced by friction against the seabed. The force from the elastic element 5 must be sufficient to prevent the radius of curvature in the horizontal plane from becoming too small. Since the friction coefficient between the pipe and the seabed is less than 1, however, the radius of curvature in the horizontal plane is always greater than in the vertical plane. The lower riser arm 1 is twisted elastically about its own axis, and the torsion moment is transferred to bending in the bottom part of the upper riser arm 3. It can be shown that the lower riser arm 1 is flexible in torsion, so that the bending moment produced thereby will be small.

When the vessel 4 moves in waves, motion components that are normal to the riser's upper arm 3 will be substantially damped due to the hydrodynamic flow resistance, while movements along the riser arm 3 will be transferred to the point 6, with the result that the lower riser arm 1 is moved across its longitudinal direction. The flow resistance influences the shape in the same way as the weight, and the force in the elastic element 5 must be sufficient to also limit this in addition to the curvature due to the flow resistance and the inertial forces.

The stresses must not exceed permitted maximum values under the following conditions:

Maximum platform movement during normal operation and in the event of accidents such as severance of one of the platform's anchor lines.

Maximum wave height.

Wear or damage to the elastic element 5.

The length of life is limited by fatigue in the material. Most vulnerable points are the bend 6 and the lower riser arm 1 near the point where it is lifted from the seabed. Wave data for the area concerned where the riser has to be used are split up into representative wave heights and periods, and a number of waves that can be expected per annum within each representative wave. The result of dynamic analyses of the riser for each such wave gives stress ranges in the various parts of the riser. From material data the number of stress cycles the riser's material can be expected to withstand is known for each stress range, assuming a given quality of welded joints. The fatigue life can therefore be estimated.

If one disregards the bending stiffness, in principle the static shape can be calculated manually. In practice a general computer program such as MathCAD is employed.

The static shape of the riser under the influence of currents and the movements and stresses resulting from wave movements are calculated by means of dynamic computer programs.

Below there is given an example on design of a riser in accordance with the invention for an actual application, with the following parameters:

Water depth 330 m

The riser is connected to the vessel 4 13 m above the surface.

Platform movements+/−120 m in the horizontal plane.

Riser diameter 150 m internally, 182 m externally.

The connection point 2 for the riser is 63 m to the right of the connection point on the vessel 4 when the latter is in its neutral position.

Maximum wind and current move the vessel 4 approximately 33 m from the calm water position, the greatest wave height is 32.5 m, and the associated wave period is between 15 and 18.3 seconds.

The point where the riser's upper arm 3 is connected to the vessel 4 then moves approximately 10 m vertically and 25 m horizontally, with a period equal to the wave period.

The design of a riser in accordance with the invention then becomes as follows:

Lower riser arm 1 has a length of 230 m. Upper riser arm has a length of 313 m. The elastic element consists of 8 parallel polyester ropes with an 18 mm diameter core, 810 m long. The anchor 7 is located 930 m to the left of the connection point on the vessel 4 when the platform is in its neutral position.

The results of static and dynamic calculations are:

The shape has high natural frequencies, with the result that the dynamic oscillations are not amplified by the mass inertia in the structure. The stress range is therefore relatively small. The bending stress in the lower riser arm 1 near the point where it is lifted from the seabed alternates between 0 and approximately 90 MPa. For smaller waves the stress range is correspondingly less, and the fatigue life is estimated to be adequate, assuming a method of construction as outlined below.

The rope tension corresponds to approximately 23% of the rope's breaking load when the platform is in its neutral position, and the force increases to approximately 58% of the breaking load when the platform is in its extreme right position H. Here it is assumed that the riser is filled with a medium that has a density of 800 kg/m$^3$, corresponding to normal operation. During installation or abnormal conditions, the density may be altered, and forces and bending stresses will therefore also be altered.

The elastic element 5 is as earlier mentioned preferably a rope of synthetic material, it may also consist of several ropes or similar. According to suppliers of polyester rope, with use of this kind the rope will have almost unlimited fatigue life. If the rope is stretched to its maximum estimated force during initial operation, its length will not subsequently alter to any noticeable extent.

Other materials than polyester, e.g. nylon, may also be employed. If so desired, the rope can be braided or twined round a rubber core over a part of its length in order to further increase its flexibility. Rope design of this kind in order to increase elasticity is known from elastic luggage cords for cars and from mooring ropes for small boats. Another version of the elastic element is to pass one or more ropes over pulleys on the anchor to a buoyancy body, thus reducing the maximum force in the rope. Alternatively, the rope or ropes may be passed over a pulley that is raised above the seabed, and a weight suspended on the end.

An elastic rope gives a relation between the tension and extension that is linear, which makes easier analyses to predict the behaviour. If the rope has a constant modulus of elasticity, the anchor's position and the rope's diameter and length can be calculated on the basis of two static positions for the riser's upper end. If a buoyancy body or counterweight is used, more positions are required.

Figure 3:
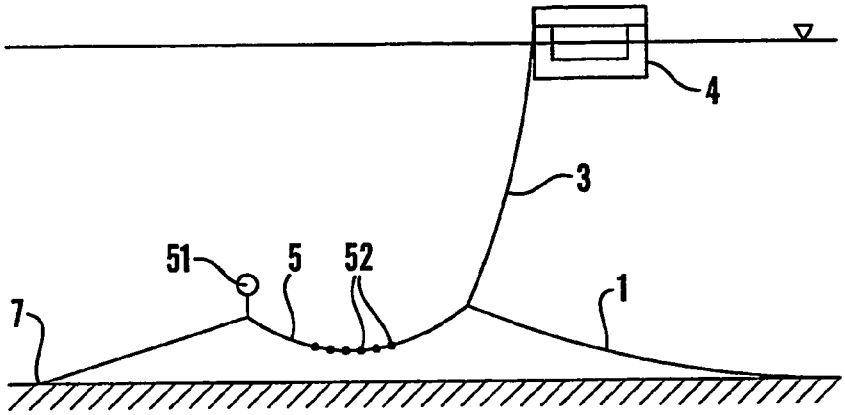

The elastic element 5 may also be a conventional chain or a combination of chain and elastic rope. The elasticity in the rope may be altered by adding buoyancy elements either concentrated as one buoy or distributed over part of the line, Weights may also be added. Both types add the shape elasticity of the configuration to the elasticity due to the rope material. A configuration like this is shown in FIG. 3, where the elastic element 5 is equipped with a buoy 51 and weights 52.

Figure 4:
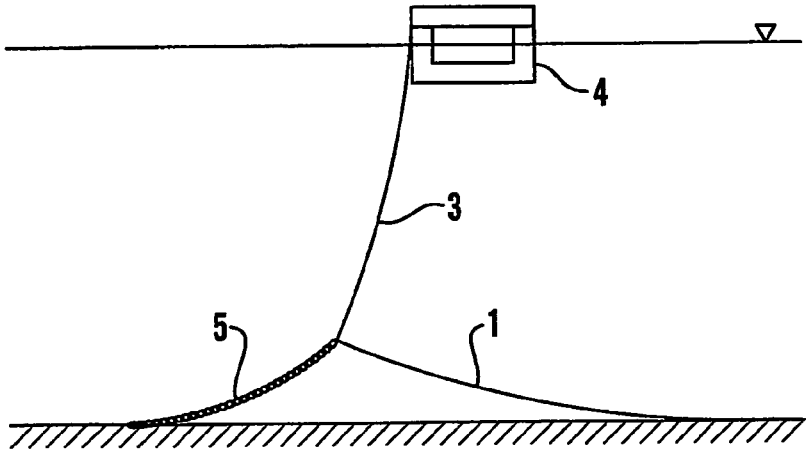

Another alternative for an elastic element is a chain, as shown in FIG. 4, where the sag in the chain causes the tension to vary with the extension. The chain will tend to take up a catenary shape, until it is stretched to a straight line. If part of the chain lies on the seabed and is lifted off gradually as tension is increased the relation between tension and extension is modified. The chain may also be build of elements having different weight/m-ratio over the length of the chain, which again will modify the characteristic of a chain as the elastic element 5.

Figure 5:
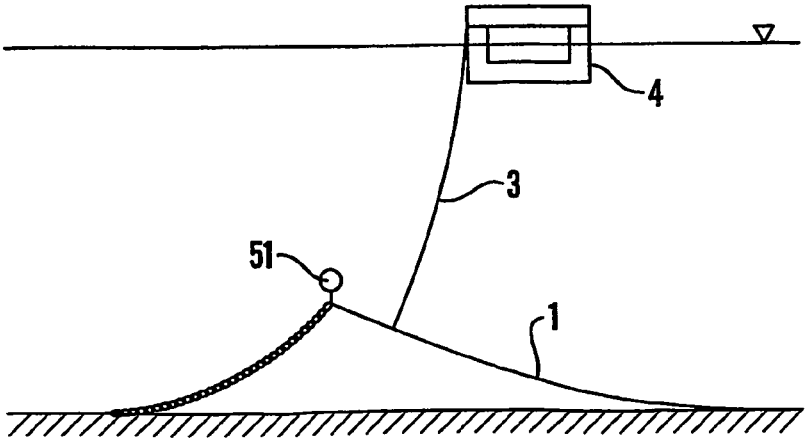

It is also possible to add a buoy on an elastic element in the form of a chain. This permits it to be used where the attachment point on the riser is closer to the seabed than without a buoy. Another possibility is as shown in FIG. 5 an elastic element 5 consisting of a section between the buoy and the bend of the riser where the elastic element 5 is a wire or synthetic rope, and the elastic element from the buoy to the anchor 7 is a chain. In this embodiment of the elastic element 5 the section of the elastic element 5 between the bend and the buoy lies in extension of the lower riser arm 1, when this is in a neutral position. An embodiment like this is used to minimize the anchor chain motion and tension variation in the lower riser arm when the platform or the vessel moves in the waves.

There is also the possibility to have the anchoring point for the elastic element 5 raised from the seabed. An anchoring point like that will resembles a connection point for a buoy but the point will be fixed. This is not shown in any figure.

Figure 6:
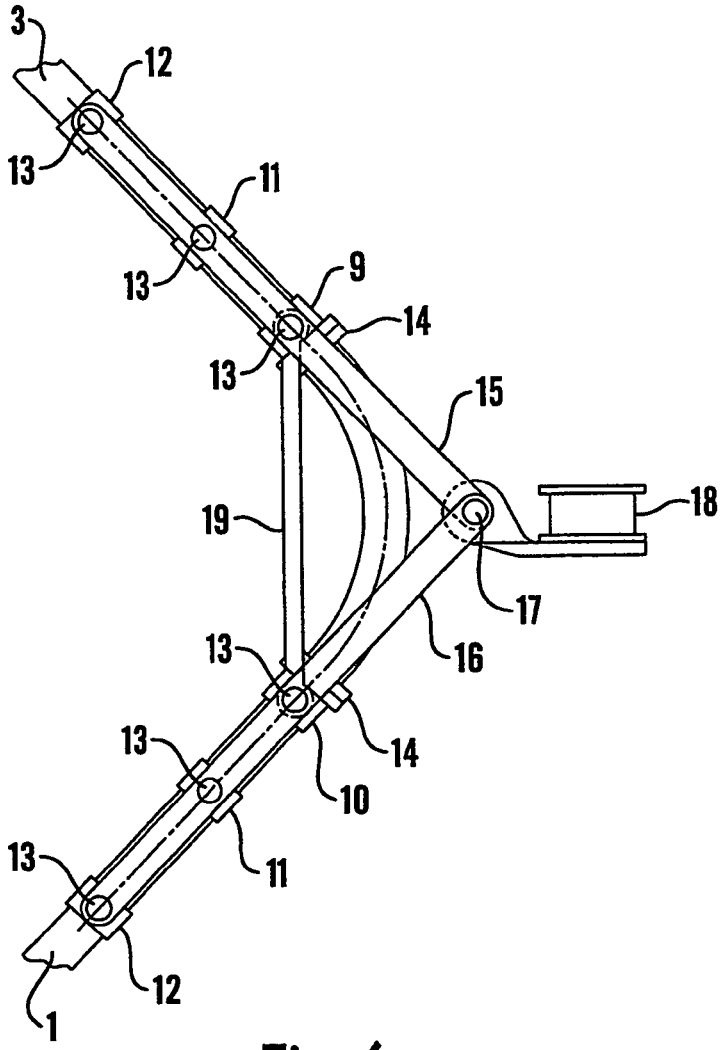
FIG. 6 shows one embodiment of the bend.

There may also be several elastic elements between the bend and the seabed. The anchor points to the seabed may for several elastic elements be fanned out, but the resulting component of the forces from the elastic elements will be in a direction mainly opposite the direction of the bottom riser The bend 6 is preferably designed as illustrated in FIG. 6. The bending moments in the lower riser arm 1 and the upper riser arm 3 increase towards to the bend 6, and the arms often must be reinforced close to the bend in order to avoid the material stresses becoming too great. A known and common solution is to increase the wall thickness in the risers locally and gradually towards the bend 6. However, in this case this is irrational since the bending moments near the bend 6 are mainly in the bend's 6 plane, with the result that there is very little loading on material near the neutral axis for such bending. Moments in the other plane are absorbed almost entirely by torsion in the lower riser arm 1, thus making reinforcement for such moments unnecessary.

Instead the pipe is stiffened by beams that are laid parallel to the pipes.

The riser's upper arm 3 and lower arm 1 are connected to a bent pipe piece. Round both arms 1 and 3 are mounted clamps 9, 10, 11 and 12. The clamps are provided with trunnions 13 that are placed normal to the riser's plane. The clamps 9 and 10 can transfer axial and transverse forces from the pipe to the trunnions 13. The clamps 11 and 12 can only transfer transverse forces. Parallel to the riser's upper arm 3 and lower arm 1 are mounted two pairs of beams 15 and 16 whose stiffest axes lie in the riser's plane. In the steps holes are provided that are adapted to hold the trunnions 13. The holes probably have to be reinforced to provide bearing area. The beams are extended until they meet in pairs in a shaft 17, which is provided with a hook 18 round which the elastic element 5 can be hooked. A beam 19 is attached between the clamps 9 and 10 in order to stiffen the bend. According to this embodiment, the tension in the pipes 1 and 3 is transferred through the clamps 9 and 10 to the beams 13-16 and from there to the anchor rope 5, while bending moments in the pipes 1 and 3 is partly transferred to the beams through the clamps 9-12. The stiffness of the beam pairs 15-16 should be greatest near the end points of the beam 19 and reduced towards both ends. If the clamps 11 are omitted, the structure will be simpler but slightly less effective.

Figure 7:
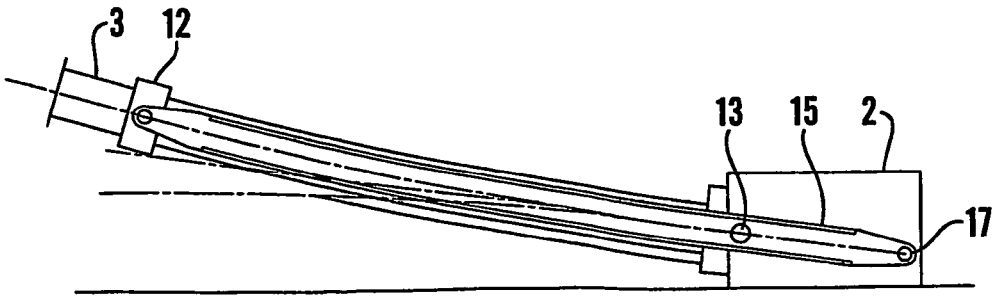
FIG. 7 shows one embodiment of the connection point to the seabed.

If necessary the lower end of the riser can be stiffened in the same way as at the bend 6 by clamps 12 and beams 15, which in this case must be fastened to the fixed connection point on the seabed. This construction is illustrated in FIG. 7. If the seabed installation cannot withstand the bending moment transferred by a steel stiffening means, the part of the riser arm nearest the seabed termination may be made of titanium. The beam height must then be reduced so that the beam can withstand this reduced bending radius.

Figure 8:
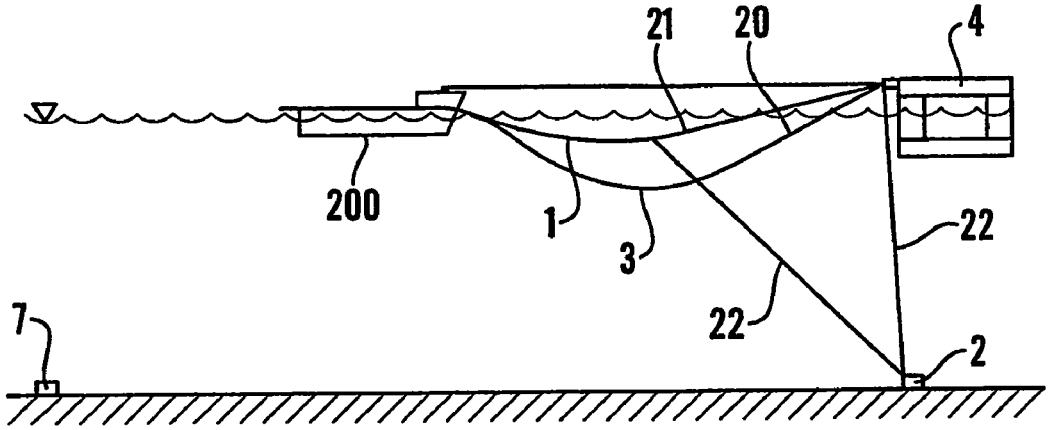
FIGS. 8 and 9 shows one possible installation procedure of a riser in accordance with the invention.
Figure 9:
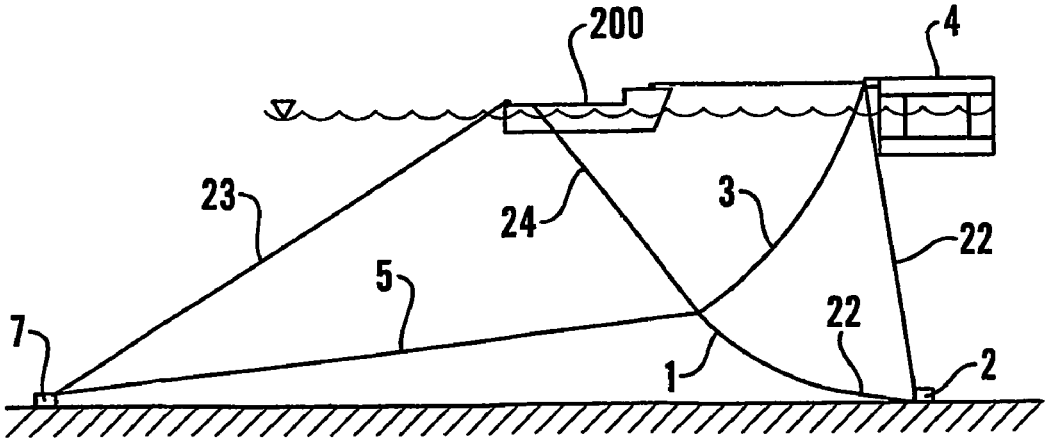

A preferred method of constructing and installing the riser in accordance with the invention is illustrated in FIGS. 8 and 9.

Standard lengths of pipe are welded together to form 60-80 m segments in an onshore workshop. The segments are terminated by welded-on flanges. Since the fatigue strength of welded connections is inferior to that of the base metal, the pipe ends are upset to greater wall thickness, thus reducing the bending stresses in the weld zone sufficiently to give a fatigue life in this area that is at least as good as that of the base material. After the welding operation, the welds are machined or ground externally and internally. For the construction described above, the pipe ends have to be upset sufficiently to ensure that the wall thickness at the weld is a minimum of 20 mm after the weld has been machined. Since standard pipe lengths are normally approximately 8 m, a tool is required that is slightly longer in order to be able to machine the welds internally. The pipe segments may also be machined externally so that the wall thickness near the welds is greater than elsewhere. Joining pipe lengths in this manner is known in the prior art. Such means to improve fatigue life may for the riser in accordance with the invention be necessary only over short parts of the riser, namely near the water surface, near the bend and near the seabed, but will often not be necessary at all.

The pipe segments are then loaded on to the installation vessel 200, which is equipped with a chute and suitable foundations for storing the pipe segments. The vessel first installs the riser anchor 7 with the elastic element 5 and an extension line 23 through a pulley on the anchor 7 and back to a winch on the installation vessel 200. Two lines 20 and 21 are connected to the platform end of the riser and the seabed end respectively, and passed through pulleys on the vessel 4 to winches on the installation vessel 200. The pull-in line 22 is passed from the seabed end of the riser to the seabed installation 2. In the figure the pull-in line 22 is passed through a pulley on the seabed installation 2 up to a winch on the vessel 4. When the lines 20 and 21 are pulled, the first segments of upper riser arm 3 and lower riser arm 1 slide in the chute on the vessel until the next segment can roll down behind them in the chute, thus enabling the flange coupling to be connected. Winches that are not illustrated are also required to ensure that the pipe segments' position in the installation vessel's longitudinal direction can be controlled.

FIG. 8 illustrates the situation while upper 3 and lower riser arms 1 are being assembled. When the assembly of upper 3 and lower riser arm 1 is complete, the line 21 is slackened so that lower riser arm 1 rotates to an almost vertical position. It is then a simple matter to connect the flange coupling to the bend 6. When the lines 20, 22, 24 and 23 are maneuvered, the vessel end of upper riser arm 3 is moved to its connection on the vessel 4, lower riser arm 1 is moved to the fixed connection point on the seabed 2 and the elastic element 5 to its connection on the anchor 7. FIG. 9 illustrates this situation.

After lower riser arm 1 is connected to the fixed connection point on the seabed 2, the elastic element 5 can be drawn tight and the other lines disconnected.

Figure 10:
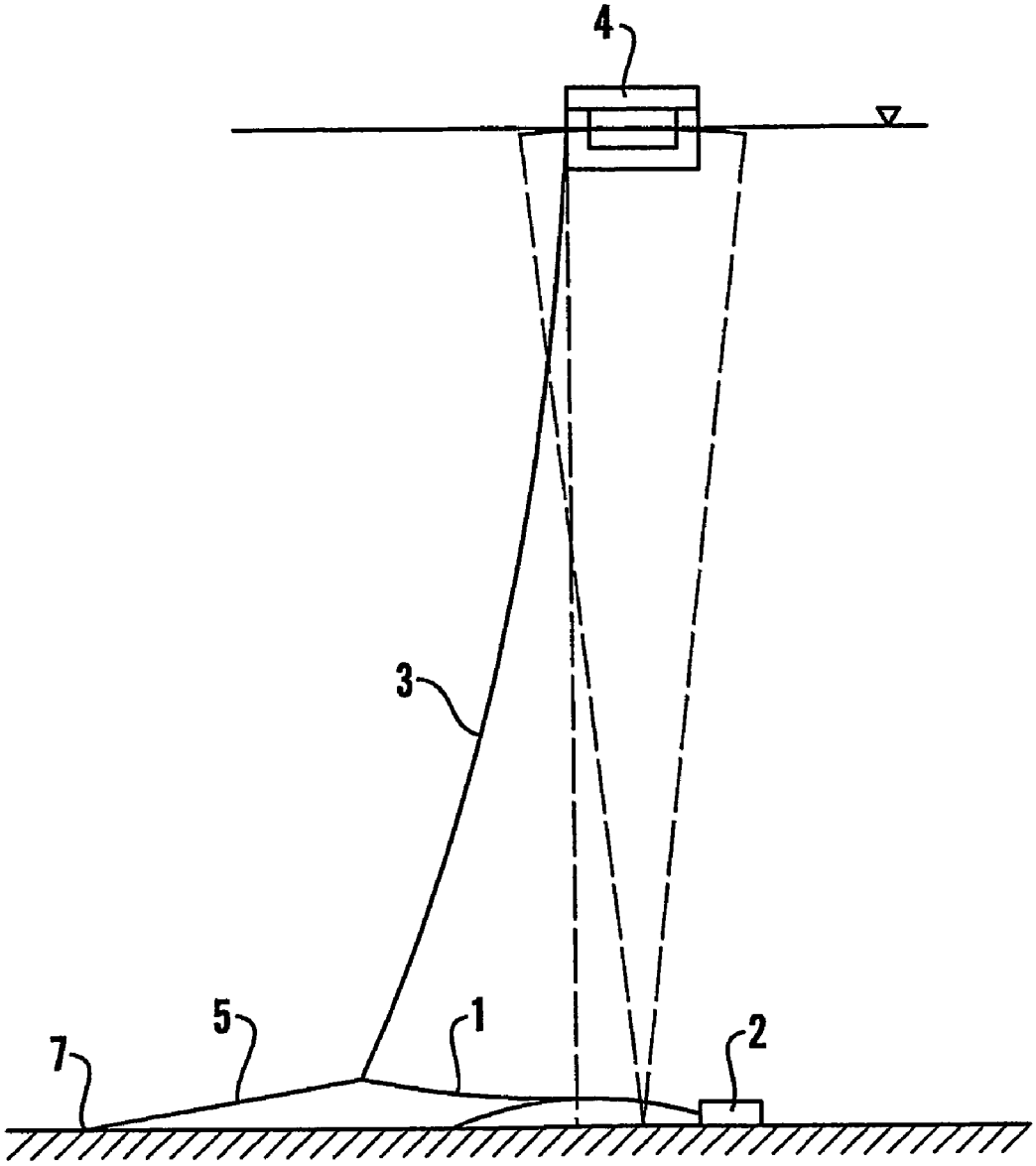
FIG. 10 shows the riser configuration in accordance with the invention in connection with a TLP-platform.

As shown in FIG. 10 may the riser in accordance with the invention be used in connection with a tension leg platform (TLP). A TLP is a semisubmersible vessel using vertical tethers between the vessel and anchors on the seabed. The sum of tether tensions corresponds to 20%-35% of the platform displacement. The TLP moves on a spherical surface when subject to forces from wind, waves and current. Maximum offset is about 10% of the water depth from the equilibrium position. This offset would correspond to about 6 degree angle from the vertical for the straight line between the platform termination and the seabed termination of a riser. The L-riser in accordance with the invention may be used to avoid heave compensator which are normally used in connection with vertical risers for TLPs, and since torsion absorbs the out-of-plane platform displacements, only the planar stress joint described in the patent application is needed, designed for maximum angular deflection of slightly more than +/−6 degrees to allow for the sag of the inclined upper riser arm. For large risers or large platform offsets it may be convenient to reduce the required flexing at the corner by building a ramp in the form of a circular arc on the seabed, placed such that, in the plane of the riser, the lower riser arm is horizontal tangent to it directly under the platform termination when the platform is in its neutral position, but in the other plane it is offset to clear seabed installations directly under the platform. Since deflections normal to the plane of the riser are small, this ramp need not be much wider than the diameter of the riser. This is shown in FIG. 10.

Risers according to the invention may preferably be made entirely of steel. For large diameters the bending stresses may become too great, and such risers may be made entirely or partly of titanium, which has approximately half the modulus of elasticity of steel. There may also be applications where it is desirable to use flexible hoses in part of the riser, since the shape requires only half the length of what is normal for such pipes. It is also possible to use risers that are constructed from a metal pipe covered by synthetic materials.

Risers according to the invention can replace existing flexible hoses. In this case the fixed connection point on the seabed 2 may be located further to the left in the figures than is illustrated in FIG. 1. This may result in the lower riser arm 1 becoming so short that the angle of its lower end approaches the horizontal when the platform is moved a maximum distance to the right. In such cases the equipment on the seabed, or the lower end of the riser, may be designed with an angle that halves the angular change in the vertical plane that is required. It is also shown here that the angular change in the horizontal plane is small, even though the vessel 4 is moved to the full extent perpendicularly to the riser's plane.

The riser configuration in accordance with the invention are above explained with different embodiments, as it will be understood for a person skilled in the invention is not limited to these embodiments from which there can be differences which are within the scope of the invention as described in the following claims.

The invention claimed is:

1. Riser for connection between a floating structure and a seabed connection point on or near the seabed for transport of fluids, electric power, signals, or combinations thereof, comprising a substantially rigid bottom riser arm and a substantially rigid top riser arm which are substantially straight in an unloaded condition, wherein the rigid bottom riser arm is connected to the rigid top riser arm by a rigid bend having a fixed angle of approximately 90 degrees, and wherein the rigid top riser arm extends from the bend to the floating structure, said floating structure being arranged such that in a neutral position (N), a vertical line drawn from the structure connection point of the rigid top riser arm with the floating structure will intersect the sea bed at a point on a same side of the rigid bottom riser as the seabed connection point, and further wherein the rigid bottom riser arm rests upon the seabed from the seabed connection point that is located on or near the seabed to a transition point intermediate said seabed connection point and the bend, said transition point being immediately prior to the point at which the rigid bottom riser arm is lifted from the seabed, which transition point changes dependent upon the position of the floating structure, said transition point further being approximately on a vertical line from the structure connection point to the floating structure when the structure is in the neutral position (N), said riser further comprising at least one elastic element extending from the bend to an anchor on the seabed in a distance from the bend such that the bend is located intermediate the seabed connection point on or near the seabed and the anchor.

2. Riser according to claim 1 wherein the portion of the rigid bottom riser arm that is in near proximity to the bend rests upon the seabed when the floating structure is in vertical alignment with the bend.

3. Riser according to claim 1, wherein, the longitudinal axis of a portion of the rigid bottom riser arm which extends from the transition point to the bend forms an acute angle in relation to the seabed, and whereby the entire length or parts of said portion have a catenary shape.

4. Riser according to claim 1, wherein the angle between the elastic element and the rigid top riser arm, opposite the rigid bottom riser arm, is between 60 and 180 degrees.

5. Riser according to claim 1, the elastic element is so mounted that it absorbs tension forces in a horizontal plane.

6. Riser according to claim 1, wherein the elastic element comprises buoyancy elements, weights, or combinations thereof.

7. Riser according to claim 6, wherein the elastic element comprises a chain that is arranged in such a manner that its own weight, or the weight of optional additional weight elements, causes the chain to assume a curved orientation having slack, said slack thereby providing an elastic-functioning effect.

8. A riser according to claim 1, wherein the bend includes a pipe bend and two pairs of straight beams, arranged in the pipe bend's plane, where each of the beam pairs is connected with the riser or the pipe bend or both at two or more points, with the result that axial forces are transferred to the beams and bending forces are distributed between the pipe bend and the beam pairs, that the beams are extended until they meet in a connection point, formed as a connecting element with a attachment point for the elastic element.

9. A riser according to claim 8 wherein the connecting element includes a hook for attachment of the elastic element.

10. A riser according to claim 9 wherein the bend also includes a crossbeam fastened between the pairs of beams, for supporting the angle between the beam pairs.

* * * * *